US006087941A

United States Patent [19]

Ferraz

[11] Patent Number: 6,087,941

[45] Date of Patent: Jul. 11, 2000

[54] WARNING DEVICE FOR ALERTING A PERSON FALLING ASLEEP

[76] Inventor: Mark Ferraz, 33 Island Estates Pkwy., Palm Coast, Fla. 32137

[21] Appl. No.: 09/391,671

[22] Filed: Sep. 8, 1999

Related U.S. Application Data

[60] Provisional application No. 60/099,858, Sep. 1, 1998.

[51] Int. Cl.[7] ..... G08B 23/00

[52] U.S. Cl. ..... 340/575; 340/576

[58] Field of Search ..... 340/576, 575, 340/503, 504, 505, 566; 351/158

[56] References Cited

U.S. PATENT DOCUMENTS

| | | | |
|---|---|---|---|
| 4,764,668 | 8/1988 | Hayard . | |
| 5,260,556 | 11/1993 | Lake et al. . | |
| 5,323,190 | 6/1994 | Onufryk | 351/151 |
| 5,395,181 | 3/1995 | Dezse et al. . | |
| 5,469,143 | 11/1995 | Cooper | 340/575 |
| 5,505,964 | 4/1996 | Obraztsov . | |
| 5,554,841 | 9/1996 | Kost et al. . | |
| 5,570,698 | 11/1996 | Liang et al. . | |
| 5,581,070 | 12/1996 | Dvorkis et al. . | |
| 5,581,072 | 12/1996 | Bridgelall et al. . | |
| 5,583,590 | 12/1996 | Clupper . | |
| 5,610,673 | 3/1997 | Rafal et al. . | |
| 5,638,176 | 6/1997 | Hobbs et al. . | |
| 5,644,642 | 7/1997 | Kirschbaum . | |
| 5,682,144 | 10/1997 | Mannik . | |
| 5,689,619 | 11/1997 | Smyth . | |
| 5,745,038 | 3/1997 | Vance | 340/575 |

FOREIGN PATENT DOCUMENTS

| | | |
|---|---|---|
| 820797 | 4/1981 | U.S.S.R. . |
| 2 215 040 | 9/1989 | United Kingdom . |

*Primary Examiner*—Jeffrey A. Hofsass
*Assistant Examiner*—Daniel Prévl
*Attorney, Agent, or Firm*—Richard C. Litman

[57] ABSTRACT

A warning system for warning a user that they have fallen or are about to fall asleep is disclosed. The system includes a contact lens having a detectable feature such as a holographic marking or other markings or indicia, metallic substances, color, or some microcircuit device, which will be worn by the user. The system also includes a detector or sensing device that can detect the presence of the contact lens when the eyelids of the person wearing the contact lens are open. The type of detector will vary depending upon the type of detectable feature incorporated into the contact lens. When the eyelids of the user become heavy or close, so as to cover a substantial portion of the detectable feature of the contact lens for a predetermined period and/or at a predetermined frequency, then the detector will generate a signal to thereby awaken the user.

20 Claims, 9 Drawing Sheets

WARNING DEVICE FOR ALERTING A PERSON FALLING ASLEEP

CROSS-REFERENCE TO RELATED APPLICATION

This application claims the benefit of U.S. Provisional Patent Application Ser. No. 60/099,858, filed Sep. 1, 1998.

BACKGROUND OF THE INVENTION

1. Field of the Invention

The present invention relates to a device which will warn the operator of a vehicle, or any other type of machinery, that they may be falling asleep.

2. Introduction and Description of Related Art

Each year a large number of traffic related fatalities are attributed to vehicle operators falling asleep at the wheel of their vehicles. To reduce the incidence of sleep related fatalities, devices that warn a person of their sleepy or drowsy condition have been proposed in the art. However, none of the previously proposed devices combine an ophthalmic contact device having a detectable feature and a detector which can detect that feature, with the detector sounding an alarm when the feature is not detectable because of the closing of a person's eyelids. In addition to vehicle operators, there are a myriad of other professions and/or circumstances where a device for alerting a person who is about to fall asleep would be found useful. Therefore, although the present invention is discussed in the context of alerting a vehicle operator, it should be understood that the present invention is applicable to anyone operating any type of machinery or performing any type of duty where the person performing the duty needs to stay alert.

U.S. Pat. No. 5,505,964, issued to Nickolay Obraztsov on Apr. 9, 1996, discloses a vision correction means including holographic particles suspended in a liquid carrier. The vision correction means is applied to the eyes in the form of eye drops. Obraztsov does not disclose an ophthalmic contact device having a detectable feature used in conjunction with a detector which can detect that feature and which sounds an alarm when the feature is not detectable because of the closing of a person's eyelids.

U.S. Pat. No. 5,570,698, issued to Cheng-Chung Liang et al. on Nov. 5, 1996, discloses a system for monitoring a person's eyes for detecting sleep behavior. The system of Liang et al. uses a camera to record sequential images of the human face. Signals are generated based upon the images and processed to detect eye and head movements indicative of sleepiness. Liang et al. do not use an ophthalmic contact device as part of their system.

U.S. Pat. No. 5,583,590, issued to Harold E. Clupper on Dec. 10, 1996, discloses a system for warning of sleepiness which uses electrodes placed about the eyes and a tilt meter to detect sleepiness of a person. The Clupper patent does not use an ophthalmic contact device as part of the disclosed system.

U.S. Pat. No. 5,610,673, issued to Marc D. Rafal et al. on Mar. 11, 1997, discloses a system for detecting the position of the pupil of an eye by projecting two infra red spots on the eye. Rafal et al. do not use an ophthalmic contact device as part of their system.

U.S. Pat. No. 5,638,176, issued to Philip C. D. Hobbs et al. on Jun. 10, 1997, discloses a system for tracking the eye using the interference fringes between the corneal glint and retinal reflections caused by a laser beam. Hobbs et al. do not use an ophthalmic contact device as part of their system.

U.S. Pat. No. 5,644,642, issued to Alan R. Kirschbaum on Jul. 1, 1997, discloses an apparatus for tracking eye movements using short coherence length interferometry. The Kirschbaum patent does not use an ophthalmic contact device as part of the disclosed system.

U.S. Pat. No. 5,682,144, issued to Kallis Hans Mannik on Oct. 28, 1997, discloses an apparatus for detecting whether or not a driver has fallen asleep. The apparatus of Mannik uses a light emitter mounted to eyeglasses. The emitter sends a beam across the surface of the eye ball to a detector which is also mounted to the eyeglasses. When eyelids are shut the beam is disrupted thus detecting whether or not a driver has fallen asleep. The apparatus of Mannik does not use an ophthalmic contact device with a detectable feature.

U.S. Pat. No. 5,689,619, issued to Christopher C. Smyth on Nov. 18, 1997, is directed to an eye movement tracker for use with a heads-up display. The device of Smyth incorporates well known eye tracking means such as pupil trackers and trackers using lumbus boundary, double punkenje image, corneal reflections or retinal images. An ophthalmic contact device is not used as part of the Smyth system.

United Kingdom Patent Application Number 2215040, by William George David Ritchie, dated Sep. 13, 1989, shows a device for warning a driver of having fallen asleep, which uses a camera to monitor the driver's eyes. An ophthalmic contact device is not used in the system of Ritchie.

Soviet Document Number 820797, by R. V. Daminov, dated Apr. 18, 1981, shows the use of electrodes to monitor electrophysiological activity around the eyes. Daminov does not refer to the use of an ophthalmic contact device.

None of the above inventions and patents, taken either singly or in combination, is seen to describe the instant invention as claimed.

SUMMARY OF THE INVENTION

The present invention is directed to a warning system for warning the operator of a vehicle that they have fallen or are about to fall asleep. The system includes an ophthalmic contact device having a detectable feature such as a holographic marking or other markings or indicia, metallic substances, color, or some microcircuit device, which will be carried in or on the eye of a vehicle operator. The phrase "ophthalmic contact device" as used herein, is intended to refer to any device designed to remain in contact with the tissues of the eye while the person on whom the device is carried is able to carry on their normal activities. Therefore, ophthalmic contact devices are intended to include devices designed to be worn in contact with the retina and/or sclera, such as a contact lens, and intraocular implants. The detectable feature of the ophthalmic contact device may be applied on or near the surface of the device, or the detectable feature may be embedded in the ophthalmic contact device. The system of the present invention also includes a detector or sensing device (e.g. camera, photodetector, radio receiver, etc.) that can detect the presence of the detectable feature of the ophthalmic contact device when the eyelids of the person wearing the ophthalmic contact device are open. The type of detector will vary depending upon the type of detectable feature incorporated into the ophthalmic contact device. When the eyelids of the person wearing the ophthalmic contact device become heavy or close, so as to cover the detectable feature of the ophthalmic contact device for a predetermined period and/or at a predetermined frequency, then the detector will generate a signal to, for example, sound an audible alarm to thereby awaken the person wearing the ophthalmic contact device.

Accordingly, it is a principal object of the invention to provide a system for warning a person that they have fallen or are about to fall asleep.

It is another object of the invention to provide a warning system that warns a user that they are falling asleep while allowing reasonable freedom of movement to the user.

It is a further object of the invention to provide a warning system that warns a user that they are falling asleep while reducing false alarms due to blinking and movement of the eye.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
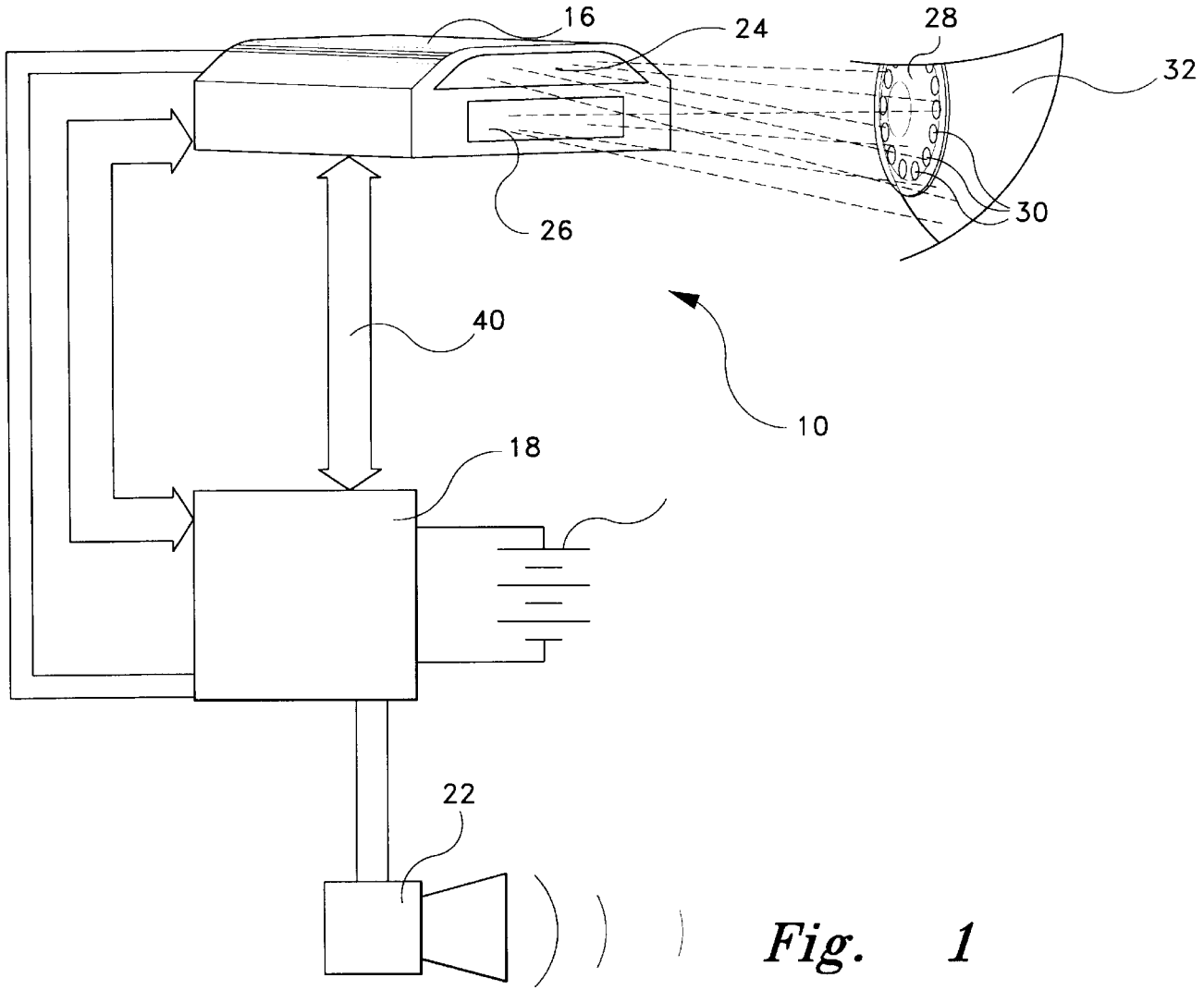
FIG. 1 is a diagrammatic environmental view showing the functional components of the warning device of the present invention.
Figure 2:
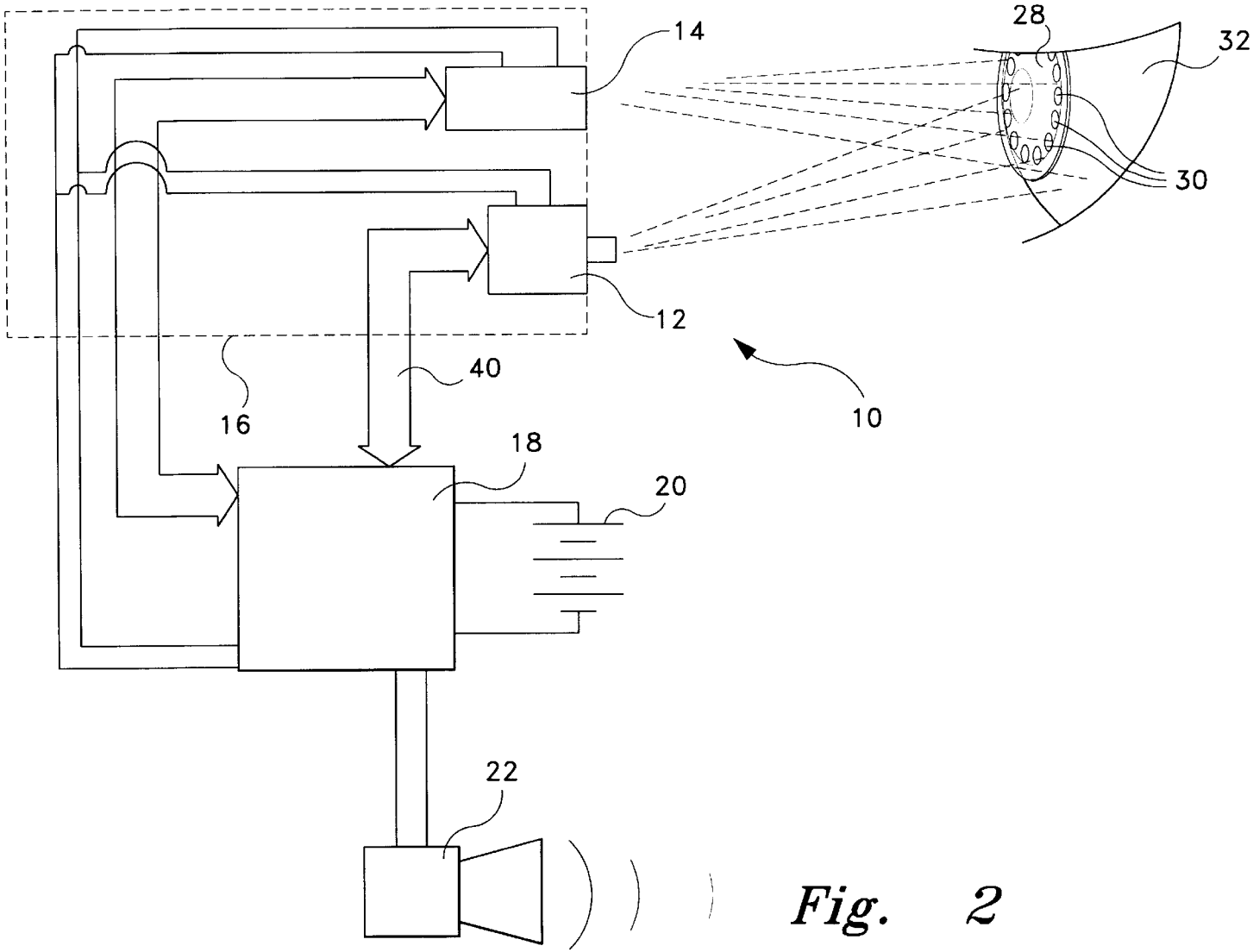
FIG. 2 is a diagrammatic environmental view showing the internal functional components of the scanner/detector unit of the warning device of the present invention.
Figure 3:
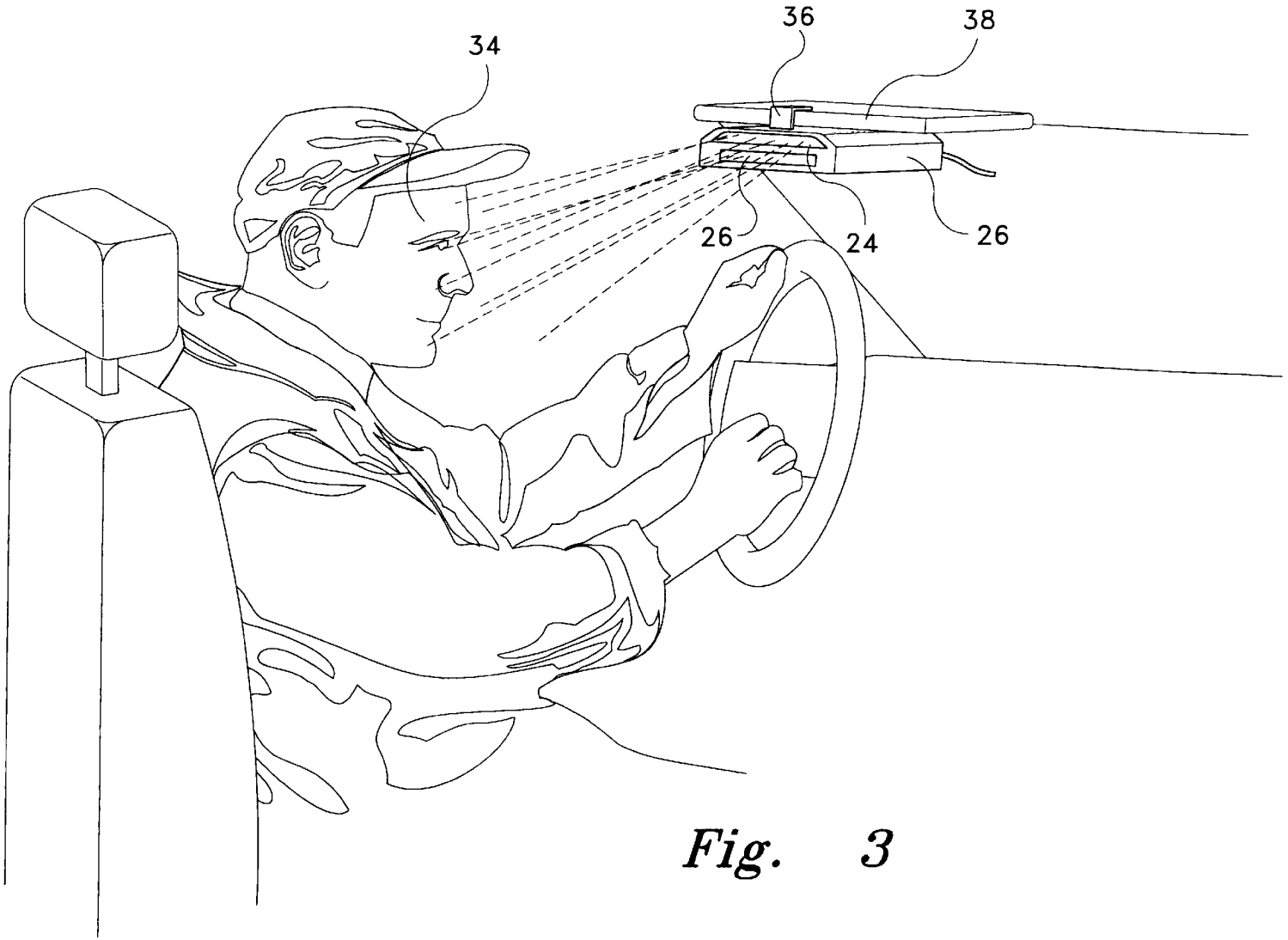
FIG. 3 is an environmental view showing the positioning of the detector unit relative to the operator of a vehicle.

Referring to FIGS. 1, 2, and 3, a warning device or system 10 for warning an operator of a vehicle that they may be falling asleep can be seen. The main functional components of the warning system 10 are the detector 12, the beam scanner 14, data processing and control circuitry 18, power supply 20, audible alarm 22, and the contact lens 28 having detectable features 30 arranged symmetrically about the periphery of the contact lens. The contact lens 28 is provided as an example of ophthalmic contact devices which may be used with the present invention. In addition to a contact lens, the use of an intraocular implant which is equipped with a detectable feature is also contemplated as being within the spirit and scope of the present invention. The contact lens 28 need not provide any vision correction if none is required. Preferably, the detector 12 and the beam scanner 14 are housed in a detector/scanner housing 16. The detector/scanner housing 16 has a transparent window 24 to allow the output of the beam scanner 14 to pass through to the vehicle operator's eyes 32 and face. In addition, the detector/scanner housing 16 has a second transparent window 26 to allow emissions from the detectable features 30 to pass through to the detector 12.

As seen in FIG. 3, the housing 16 can be provided with a clip 36 to allow the housing 16 to be mounted to, for example, an automobile's sun visor 38. Once mounted to the visor 38, the housing 16 is positioned within the frontal arc of the face of the vehicle operator 34, and the windows 24 and 26 point toward the vehicle operator's face. In addition to being mounted to a sun visor, one or more of the detector 12, the beam scanner 14, the data processing and control circuitry 18, the power supply 20, and the audible alarm 22 of the system 10 may be integrally built into the cockpit of a vehicle or aircraft or otherwise placed in the general vicinity of the operator 34, or one or more of these components may be incorporated in eye wear or in headgear.

Figure 4:
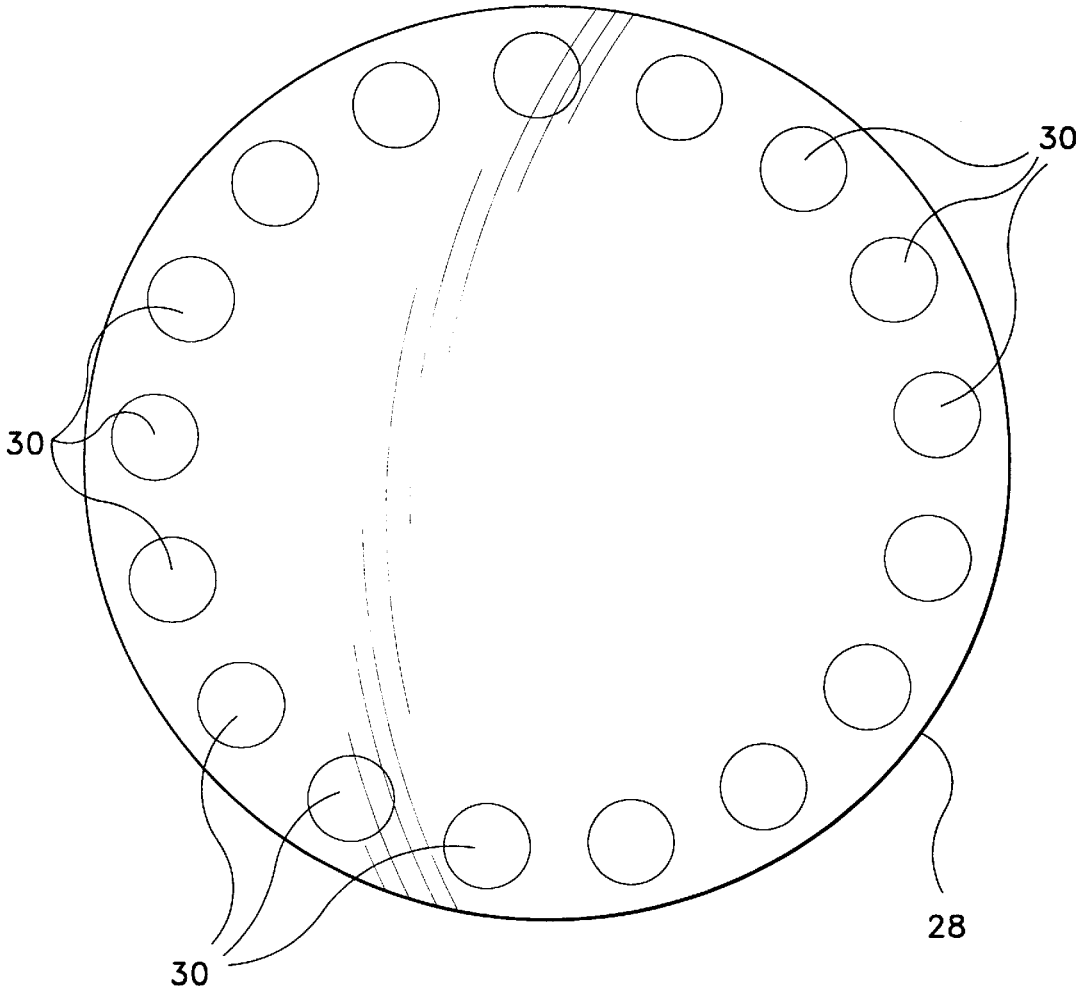
FIG. 4 is an elevational view of a contact lens usable as part of the present invention showing the rotationally symmetrical arrangement of the detectable features about the circumference of the contact lens.

Referring to FIG. 4, a contact lens 28 usable as part of the warning system 10 can be seen. The contact lens 28 has a plurality of detectable features 30 arranged symmetrically in or on the periphery of the contact lens 28. The detectable features 30 are evenly spaced along a circular path concentric with the outer circumference of the contact lens 28. The detectable features 30 should be sufficiently close to the outer circumference of the contact lens 28 so as not to interfere with the vision of the wearer (in this case the vehicle operator 34) of the contact lens.

Preferably, the detectable features 30 are embedded in the contact lens so as to minimize irritation to the wearer's eye. In general, any ophthalmic contact device suitable for use with the present invention should not interfere with the user's vision or the user's ability to blink normally. The contact lens 28 is designed to be worn in contact with the eye over the pupil and iris area and may even cover portions of the sclera of the eye. If no vision correction is required, the ophthalmic contact device used with the present invention may even be annular in shape and be worn in contact with the sclera and/or portions of the cornea over the iris. The contact lens 28 may incorporate vision correction if needed and at the option of the user.

In its most basic form, the detectable features 30 are uniform pads of reflective material. Suitable reflective material include, but are not limited to, metals such as gold, silver, and aluminum. Alternatively, the detectable features 30 may be freznel type holograms that reflect light in a characteristic manner.

The beam scanner 14, the detector 12, and the data processing and control circuitry 18 are all well known in the art and are commonly used in barcode scanning systems. The beam scanner 14 generally includes a laser light source which projects a laser beam. The particular laser light source must of course be of a type that is harmless to the eye. In addition to a laser light source, it should readily be apparent to those skilled in the art that any other suitable source of incident energy that is harmless to the eye, including infrared radiant energy, may be used in the present invention. The laser beam is scanned in the horizontal and vertical directions by either mechanically moving the laser or moving the laser beam by a system of rotating mirrors. With the detector/scanner housing 16 positioned as shown in FIG. 3, The laser beam will be scanned across a wide area about the vehicle operator's face. With the vehicle operator wearing the contact lens 28, the laser beam will be reflected more intensely when the laser beam impinges the detectable features 30 than when the laser beam strikes the other areas of the face and eyes.

The reflections from the vehicle operator's face, eyes, and the detectable features 30 are sensed and transduced into an electrical signal by the detector 12. The detector 12 can be of any suitable type. In the most basic form of the system 10, the detector 12 is a photodiode selected to be responsive to the wavelength of the output of the laser used in the beam scanner 14. Other suitable detectors include, but are not limited to, charge coupled devices.

The output of the detector 12 is supplied to the data processing and control circuitry 18 via electrical connection 40. The data processing and control circuitry 18 also controls the operation of the beam scanner 14 via the control and data bus 41. Power for energizing the detector 12 and the beam scanner 14 is supplied from the data processing and control circuitry 18 via the conductors 43 and 45. Like the detector 12 and the beam scanner 14, the data processing and control circuitry 18 is well known in the art and will not be discussed in detail here. The data processing and control circuitry 18 is preferably microprocessor based. The output from the detector 12 is usually fed to a well known circuit component known as a peak detector. The peak detector detects output from the detector 12 which corresponds to reflections above a predetermined threshold intensity. The threshold intensity is selected such that reflections above the predetermined threshold intensity would be due to reflections from the detectable features 30. A running record of the time elapsed since the last detected reflection which exceeded the threshold, is kept by a timing circuit within the data processing and control circuitry 18. The running record of elapsed time is constantly compared to a predetermined maximum time period stored in the memory circuits within the data processing and control circuitry 18. Each subsequent detected reflection which exceeds the threshold resets the running record of elapsed time. If at any time the running record of elapsed time exceeds the predetermined maximum time period then the alarm 22 is sounded. The predetermined maximum time period could be user programmable within certain limits. These limits would be set by the manufacturer of the system 10. The greatest duration to which the predetermined maximum time period could be increased would be based on safety considerations, such that even if the predetermined maximum time duration is increased to its greatest possible extent, the alarm will sound before there has been much of an opportunity for the vehicle operator's sleepy condition to cause damage to lives and property. The lower limit on the predetermined maximum time period would be based on the need to avoid false alarms due to innocuous activity such as blinking or normal movements of the head. The upper limit of the predetermined maximum time period would be on the order of a few seconds.

In addition, it may be desirable to trigger an alarm even when the eyelids are not fully closed. Such a situation would arise when the eyelids close sufficiently to impair vision, but the eyelids do not close enough to cover all the detectable features 30. By increasing the predetermined threshold, the system described above will cause an alarm even when a few of the detectable features 30 remain uncovered by the eyelids. Depending upon the number of the detectable features 30, the predetermined threshold intensity can be selected such that reflections due to fewer than a predetermined number of detectable features 30 will cause an alarm. For example, if there are forty detectable features 30 distributed around the contact lens 28, the predetermined threshold intensity can be selected such that reflections due to fewer than five or six detectable features 30 will cause an alarm if such a condition persists for the predetermined maximum time period. The actual number of detectable features 30, whose reflected intensity corresponds to the predetermined threshold intensity, would be equal to the number of detectable features 30 which remain uncovered when the eyelids have sufficiently closed to completely cover the pupil of the eye and thus block vision.

The laser of the beam scanner 14 should be of a type or of a power output that will not cause damage to the eyes. Also, it would be preferable to use an infrared laser such that the beam will be invisible and will not distract the vehicle operator. As shown in U.S. Pat. No. 5,638,176, which is incorporated herein by reference, lasers that are safe for the eyes are known in the art.

Although in the illustrated example a detector generating an electrical output is used, it is possible that detectors generating non-electrical outputs may also be used in the warning system 10 without departing from the spirit and scope of the present invention.

In use, the vehicle operator would wear the contact lens 28 and position the detector/scanner housing 16 as shown in FIG. 3. The beam scanner 14 scans a laser or other light beam across the face and eye area of the vehicle operator. While the vehicle operator's eyes are open, signals reflected or otherwise emitted by the detectable features 30 will be picked up by the detector 12 at a relatively high frequency proportional to the rate at which the frontal area of the vehicle operator's face is scanned. When the vehicle operator's eyes are shut or sufficiently closed, the reflections from the detectable features 30, as detected by the detector 12, will be below the predetermined threshold intensity due to most or all of the detectable features 30 being covered by the vehicle operator's eyelids. If the vehicle operator's eyes remain shut or sufficiently closed for a period of time exceeding the predetermined maximum time period, most likely due to the vehicle operator falling asleep or getting dangerously drowsy, then the data processing and control circuitry 18 will cause the audible alarm 22 to sound and alert the vehicle operator to the existing dangerous condition. Sweeping a large area about the vehicle operator's face with the beam from the beam scanner 14 advantageously allows reflections from the detectable features 30 to continue to be detected by the detector 12 even as the vehicle operator moves his head in the normal course of operating the vehicle. The probability of false alarms due to the normal head movements of the vehicle operator 34 is thus reduced.

Another feature of the present invention that enhances its ease of use is the symmetrical distribution of the detectable features 30 about the periphery of the contact lens 28. In general, each time the contact lens 28 is placed in the wearer's eye the contact lens is going to be randomly oriented. If a single detectable feature 30 was provided on the periphery of the contact lens 28, then the probability would be very high that single detectable feature would come to rest in a position where the single detectable feature would be covered by the upper eyelid at all times. This would cause the wearer the inconvenience of having to adjust the position of the contact lens 28 to ensure that the single detectable feature 30 will be exposed to the beam from the beam scanner 14. By providing a plurality of detectable features 30 about the periphery of the contact lens 28 this inconvenience is avoided, because, regardless of the orientation of the contact lens after placement over the pupil, several detectable features 30 will be exposed to the beam from the beam scanner 14 at all times while the wearer's eye is open. Therefore, as long as the detectable feature is symmetrically distributed about the periphery of the contact lens, any geometric shape can be employed for the detectable features 30. It should be noted however, that if a transparent detectable feature or medium is used, then the detectable feature can be located in the center of the contact lens, although even the transparent detectable feature may be distributed about the periphery of the contact lens if so desired.

Whether opaque or transparent, the detectable features 30 can be any color that contrasts with the rest of the contact lens. Further, the detectable features 30 may be more absorptive of the incident energy relative to the rest of the contact lens 28. Because the beam of incident energy is being scanned, or when a charge coupled device (CCD) is used as the detector, the detectable features 30 need only be contrasting relative to the rest of the contact lens 28.

Figure 5:
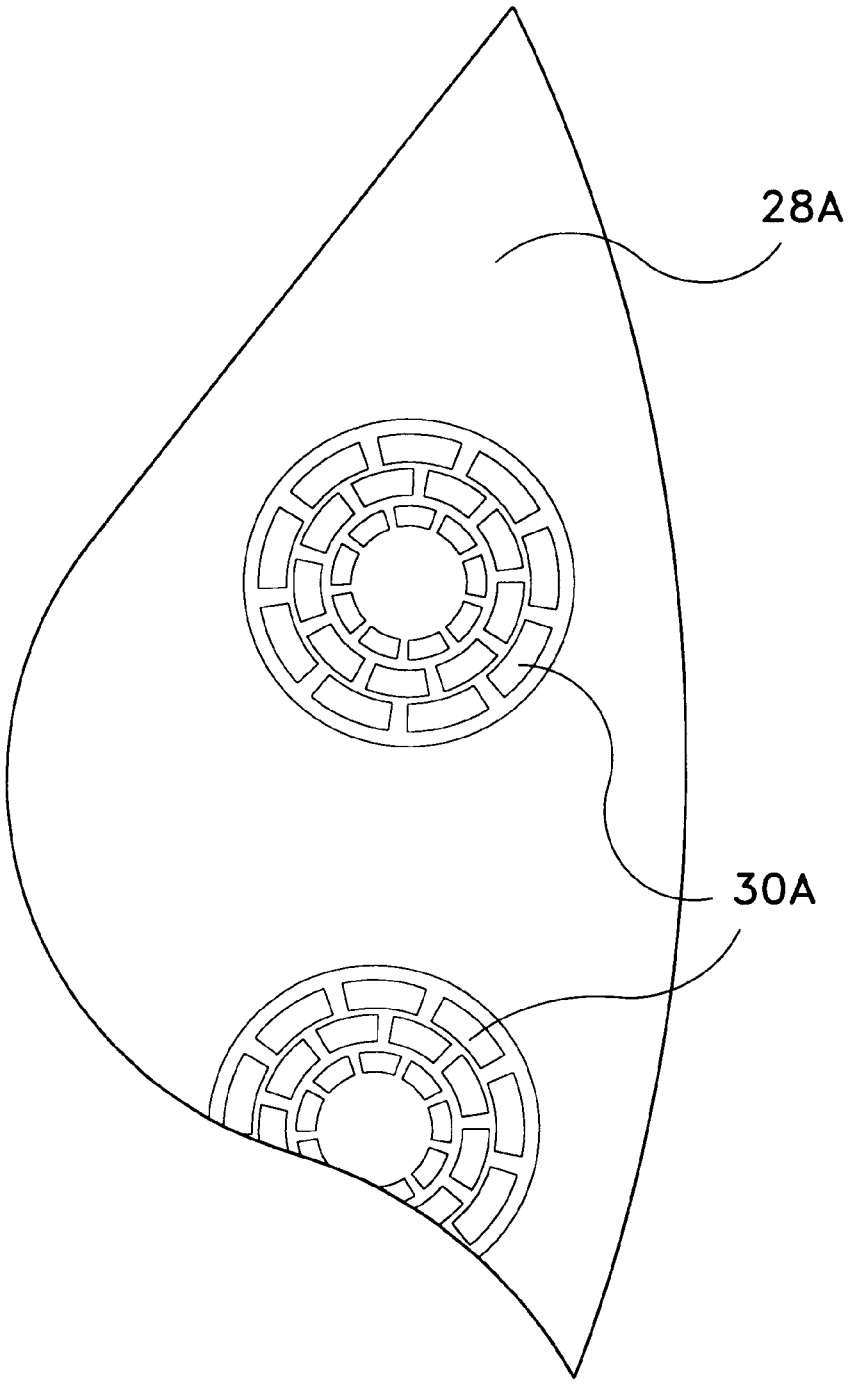
FIG. 5 is a fragmentary view showing details of the pattern of a second embodiment of the detectable feature useable as part of the warning device of the present invention.
Figure 6:
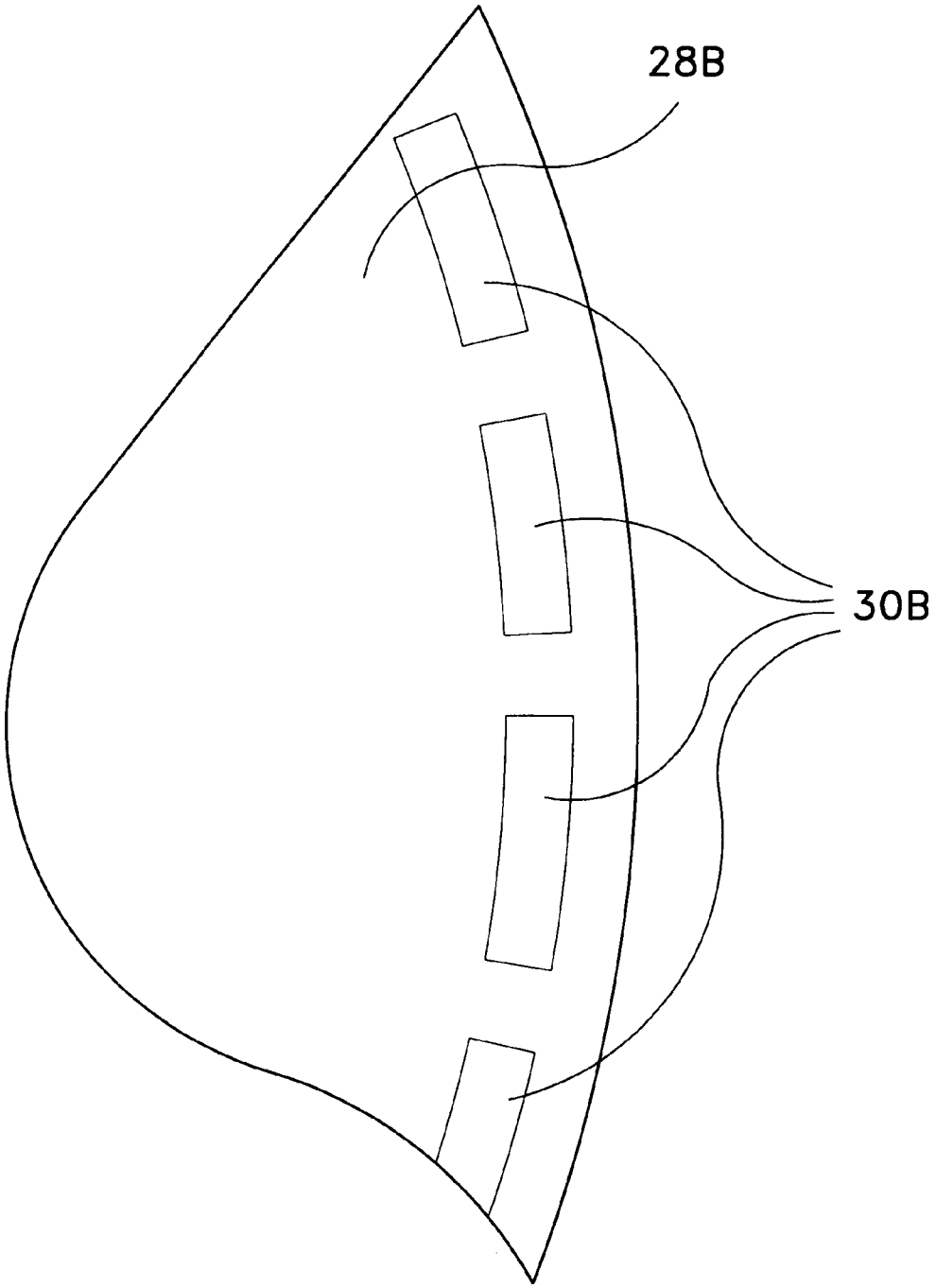
FIG. 6 is a fragmentary view showing details of the pattern of a third embodiment of the detectable feature useable as part of the warning device of the present invention.
Figure 7:
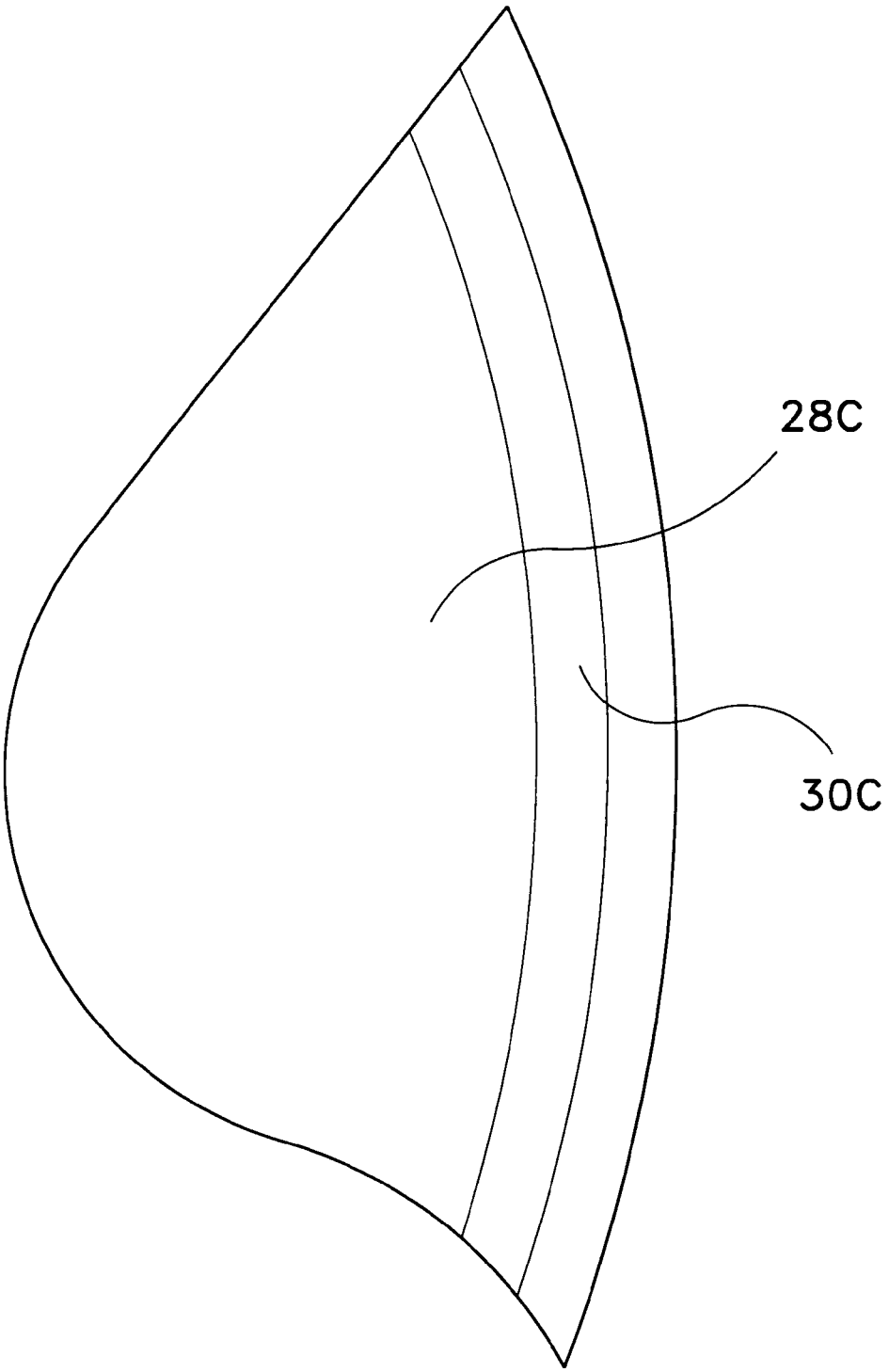
FIG. 7 is a fragmentary view showing details of the pattern of a fourth embodiment of the detectable feature useable as part of the warning device of the present invention.

Examples of alternative geometric shapes that are suitable for 20 the detectable features usable with the present invention are shown in FIGS. 5, 6, and 7. Referring to FIG. 5, a contact lens 28*a* usable as part of the warning system 10 can be seen. The contact lens 28*a* has a plurality of detectable features 30*a* arranged symmetrically in or on the periphery of the contact lens 28*a*. The detectable features 30*a* are rotationally symmetric patterns of orthogonal concentric and radial strips of reflective material. In place of the patterns shown in FIG. 5, the detectable features 30*a* can be in the form of circular barcodes as shown in U.S. Pat. Nos. 5,554,841, 5,395,181, and 5,260,556 which are incorporated herein by reference. When a circular type barcode is used as the detectable features 30*a*, the detector 12, the beam scanner 14, and data processing and control circuitry 18 can be modified in a manner well known in the barcode scanner art to identify the presence of circular barcodes, and this information can then be used to detect the open condition of the eye of the wearer of the contact lens 28*a*. In addition, the detectable features 30*a* can be square shaped linear barcodes as taught in U.S. Pat. No. 4,764,668 which is also incorporated herein by reference. Again, modifications necessary to allow the detector 12, the beam scanner 14, and data processing and control circuitry 18 to identify square shaped barcodes are well known in the barcode scanner art.

The warning system 10 with its microprocessor based data processing and control circuitry 18 is sufficiently flexible to allow various other algorithms for detecting the onset of sleep to be used with the warning system 10. For example, with a high enough beam sweep rate, the rate at which the vehicle operator 34 blinks his eyes can be monitored and compared to some reference blink rate. As shown in U.S. Pat. No. 5,570,698, also incorporated herein by reference, a marked increase in blink rate is indicative of sleepiness. Thus, by modifying the control and processing algorithm used with the warning system 10 earlier warnings of the onset of sleep may be obtained.

Another alternative algorithm for detecting the onset of sleep would be to use the intensity of the reflected beam, or the number of detectable features detected per frame swept by the beam, to determine how much of the eye is covered by the eyelids, i.e. detect whether or not the eyelids are getting heavy, to once again get an earlier warning of the onset of a dangerous sleepy condition.

Referring to FIG. 6, a contact lens 28*b* usable as part of the warning system 10 can be seen. The contact lens 28*b* has a plurality of detectable features 30*b* arranged symmetrically in or on the periphery of the contact lens 28*b*. The detectable features 30*b* are roughly in the shape of elongated, slightly arced rectangles of reflective material. FIG. 7 shows a contact lens 28*c*, also usable as part of the warning system 10, having a detectable feature 30*c* in the form of a continuous strip of reflective material around the periphery of the contact lens 28*c*. As a further alternative, a plurality of concentric strips 30*c* of varying widths, can be placed about the periphery of the contact lens 28*c* to form a relatively larger circular barcode that can be identified by the warning system 10. Again, using information well known in the barcode scanner art, the data processing and control circuitry 18 would be modified appropriately to identify the barcode formed by the plurality of the strips 30*c*.

An even simpler embodiment of the present invention could use the technology currently used in the electronic eye, used to control automatic doors, which operates on the beam obstruction principle. In this case, the beam scanner 14 would be replaced by a simpler light source that would flood the vehicle operator's face with light. The reflections from the detectable features 30 would then be picked up by the photodiode in detector 12. If the reflections are interrupted by closing of the eyelids, then an alarm will sound. In this simple embodiment a time delay, before sounding the alarm, can be used to reduce the probability of false alarms. As previously indicated, the electronics for implementing this simple embodiment are well known, and therefore, these electronics are not described in detail herein.

Figure 8:
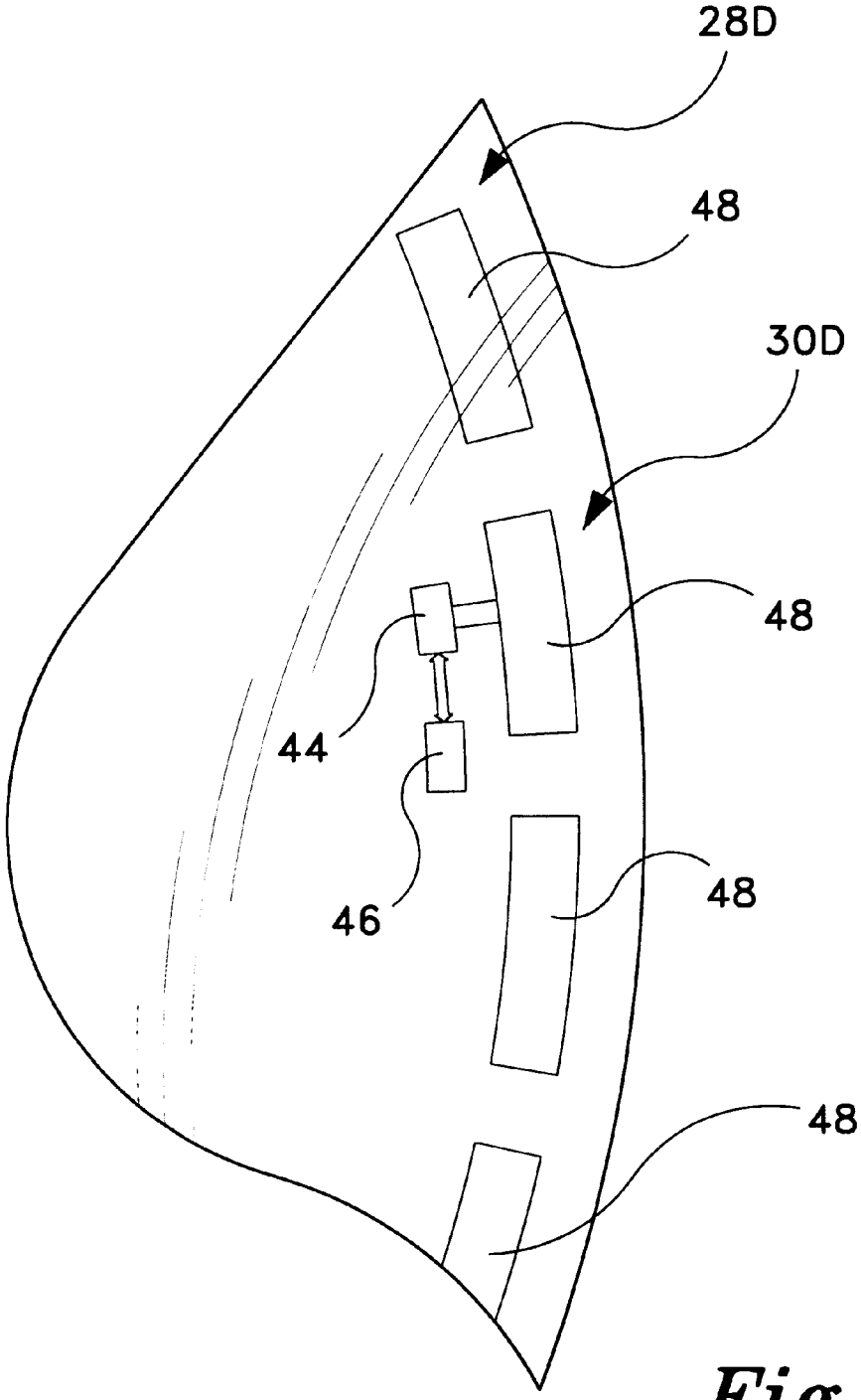
FIG. 8 is a fragmentary view showing details of a contact lens incorporating microcircuitry useable as part of a sleep warning device in accordance with the present invention.

Referring to FIG. 8, another alternative embodiment of the present invention can be seen. In this embodiment, the detectable feature 30*d*, on or in the contact lens 28*d*, includes microcircuits 44 and 46 which are capable of returning a signal of some kind to the detector 12 in response to a beam incident on the photosensitive pads 48. The photosensitive pad 48 may advantageously act as the power source for the microcircuits 44 and 46. The microcircuit 44 may condition the output of the photosensitive pad 48 to power the microcircuit 46 which may contain some sort of transmitter to signal the detector 12. The detector 12 will not be able to receive or monitor the signal from the microcircuit or chip 46 when the eyelids block the light incident on the photosensitive pads 48. Thus, closing of the eyelids can be detected and an alarm sounded after an appropriate time delay.

The microcircuit 46 can be selected to generate a radio signal or a light signal of appropriate wavelength using light emitting diodes. The detector 12 would then be a radio receiver or some type of photodetector as appropriate. A set of microcircuits 44 and 46 can be provided for each photosensitive pad 48, or a single set of microcircuits 44 and 46 can process input from all the photosensitive pads 48.

In addition to reflective material, detectable features 30, 30*a*, 30*b*, and 30*c* can be made of fluorescent or phosphorescent material which glow at a selected wavelength in response to incident light. Shutting of the eyelids would then prevent the detection of the glow by the detector 12. Once again, closing of the eyelids can be detected and an alarm sounded after an appropriate time delay.

The alarm 22 can be of any suitable type including, but not limited to, a buzzer, chime, beep, horn, or any other audible sound. The alarm 22 could also be in the form of a device that imparts a mild shock or vibration to the vehicle operator. In the case of an alarm employing electrical stimulation or vibration, the alarm 22 could be carried on the person of the vehicle operator or attached to the seat occupied by the vehicle operator.

The power source 20 is illustrated as a battery in the accompanying Figures, however, any suitable power source such as an automobile's cigarette lighter socket or solar power may be employed in the warning system 10.

Figure 9:
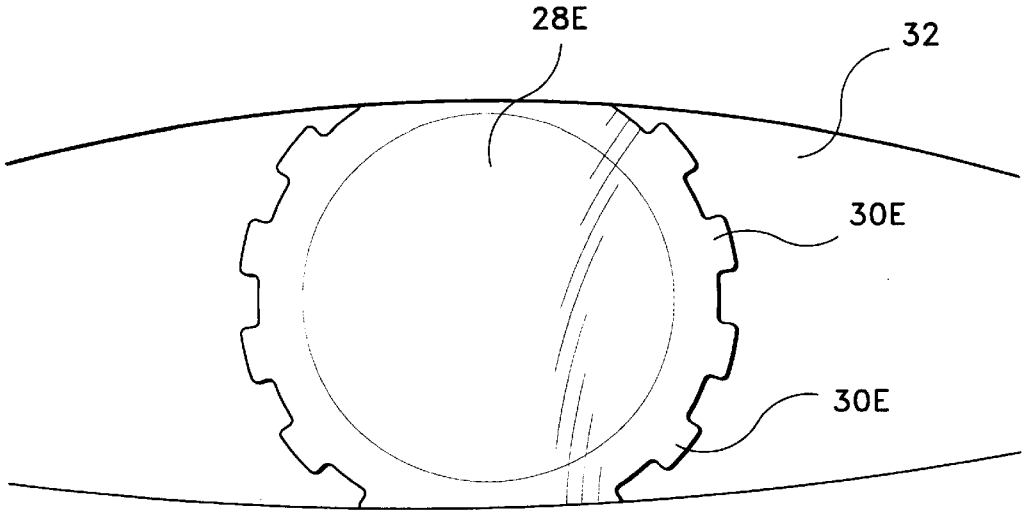
FIG. 9 is an environmental view of an alternative contact lens having rectangular projections extending radially from the periphery thereof for use with the present invention.
Figure 10:
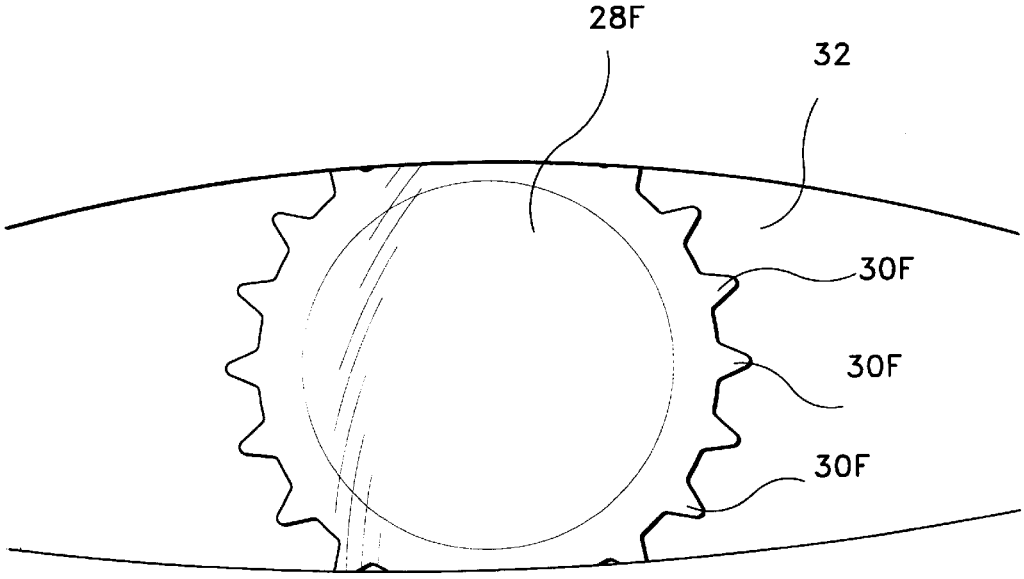
FIG. 10 is an environmental view of an alternative contact lens having triangular projections extending radially from the periphery thereof for use with the present invention.

Referring to FIGS. 9 and 10, contact lenses 28*e* and 28*f* having distinctively shaped perimeters 30*e* and 30*f* can be seen. In these embodiments, the distinctively shaped perimeters 30*e* and 30*f* act as the detectable feature. The distinctively shaped perimeters 30*e* and 30*f* generate characteristic interference patterns or images that can be readily detected and recognized using a charge coupled device (CCD) based detection system. If the characteristic image or interference pattern is not detected to the appropriate extent for the predetermined duration, then an alarm will sound. The distinctively shaped perimeter 30*e* is in the form of substantially rectangular projections extending radially from the periphery of the contact lens 28*e*. The distinctively shaped perimeter 30*f* is in the form of substantially triangular projections extending radially from the periphery of the contact lens 28*f*. The perimeters illustrated in FIGS. 9 and 10 are examples only, and any sufficiently distinctive shape may be used for the contact lens used with the warning system of the present invention.

It should be appreciated by anyone skilled in the art that a variety of other detection schemes for detecting the presence of an uncovered contact lens can be employed in the sleep warning system of the present invention without departing from the spirit and scope of the appended claims. Any of the physical properties of the contact lens, or the detectable medium thereon, could form the basis of a detection scheme. Such physical properties can include the interaction of the material of the contact lens, or the material of the detectable feature thereon, with any incident energy such sonic waves, light (visible and infrared), and radio and radar waves. As long as an appropriate detector for transducing the response of the contact lens to the incident energy is available, then an appropriate detection scheme based on that form of incident energy can be developed.

The warning system of the present invention would be useful to anyone operating any type of machinery such as an automobile, a truck, an airplane, a tractor, machine tools or industrial machinery, etc., where risk of loss of life, limb, and/or property exists if the person operating the machinery were to fall asleep. These considerations also apply to persons in the security field, air traffic control, operation of nuclear power plants, operation of railroad switching systems, and many other professions where the need exists to warn persons engaged in those professions that they may be falling asleep or becoming drowsy.

In addition to being mounted to the sun visor, the detector/scanner 16 may be free standing or integrated into headgear worn by the person using the warning system 10. Also as a further option, the detector 12, the beam scanner 14, and the processing circuitry 18, and even the battery 20, may all be integrated into the detector/scanner housing 16 as one unit.

As an added feature, an appropriate recorder, such as a recorder using semiconductor memory or a magnetic medium, may be incorporated into the warning system 10. The recorder would record the number of incidents of a person becoming dangerously sleepy during a given period of time while, for example, operating a vehicle or other machinery. This feature will allow employers to determine which employees engage in dangerous practices, and the employer can then take appropriate action to correct the problem.

It is to be understood that the present invention is not limited to the embodiments described above, but encompasses any and all embodiments within the scope of the following claims.

I claim:

1. A warning system for warning a user that a condition being one of the user having fallen asleep and the user being about to fall asleep exists, the user having at least one eye and a pair of eyelids, the eyelids varying in state from wide open to completely closed, the eyelids completely covering the eye when in the completely closed state, said warning system comprising:

an ophthalmic contact device adapted for application to the user's eye, said ophthalmic having a detectable feature which produces a signal in response to incident energy, said signal varying in response to the state of the user's eye;

a detector capable of transducing said signal into a detector output signal;

an alarm means capable of generating a stimulus that can awaken a person; and a data processing and control circuit means communicating with both said detector and said alarm means, said data processing and control circuit means being programmable, said data processing and control circuit means being programmed with criteria establishing an alarm condition corresponding with a probable condition that is one of the user having fallen asleep and the user being about to fall asleep, said data processing and control circuit means processing said detector output signal to determine if said alarm condition exists, said data processing and control circuit means controlling said alarm means to generate said stimulus if said alarm condition exists.

2. The warning system according to claim 1, said warning system further comprising:

an energy source adapted for projecting said incident energy onto at least the user's eye having said ophthalmic contact device applied thereto, said energy source being in communication with said data processing and control circuit means.

3. The warning system according to claim 2, wherein said alarm means is an audible alarm generator capable of producing an audible alarm signal that can awaken a person.

4. The warning system according to claim 2, wherein said energy source includes a laser beam source, which can produce a laser beam, and a means for scanning said laser beam at least over the area of the user's eye.

5. The warning system according to claim 1, wherein said ophthalmic contact device is a contact lens having a perimeter, and wherein said detectable feature is an optically contrasting region near said perimeter of said contact lens.

6. The warning system according to claim 1, wherein said ophthalmic contact device is a contact lens having an outer circumference, and wherein said detectable feature is a plurality of optically contrasting regions evenly spaced along a circular path concentric with said outer circumference of said contact lens and said plurality of optically contrasting regions being located near said outer circumference of said contact lens.

7. The warning system according to claim 6, wherein each of said plurality of optically contrasting regions is circular in plan view.

8. The warning system according to claim 6, wherein each of said plurality of optically contrasting regions is, in plan view, a region circumscribed by a pair of concentric circles, concentric with said outer circumference, and a pair of radii of said contact lens.

9. The warning system according to claim 6, wherein each of said plurality of optically contrasting regions is, in plan view, a region formed by a plurality of annular concentric areas and a plurality of radially extending areas which extend orthogonally in relation to said plurality of annular concentric areas.

10. The warning system according to claim 5, wherein said optically contrasting region is, in plan view, in the shape of an annular strip concentric with said perimeter of said contact lens.

11. The warning system according to claim 5, wherein said optically contrasting region is, in plan view, formed by a plurality of concentric annular strips which are concentric with said perimeter of said contact lens.

12. The warning system according to claim 1, wherein said ophthalmic contact device is a contact lens having a perimeter, said perimeter having a plurality of substantially triangular projections having rounded apices, said plurality of substantially triangular projections forming said detectable feature.

13. The warning system according to claim 1, wherein said ophthalmic contact device is a contact lens having a perimeter, said perimeter having a plurality of substantially rectangular projections having rounded corners, said plurality of substantially rectangular projections forming said detectable feature.

14. The warning system according to claim 1, wherein said data processing and control circuit means is programmed with a time limit and a threshold value for said detector output signal, said data processing and control circuit means being further programmed to control said alarm means to generate said stimulus when said detector output signal is below said threshold value for a time period not less than said time limit.

15. The warning system according to claim 1, wherein said data processing and control circuit means is programmed with a blink rate threshold and to process said detector output signal to continually determine a current blink rate of the user and to continually compare said current blink rate to said blink rate threshold, said data processing and control circuit means being further programmed to control said alarm means to generate said stimulus when said current blink rate is not less than said blink rate threshold.

16. The warning system according to claim 2, wherein said energy source and said detector are housed in a housing which is adapted for being releasably secured to the sun visor of a vehicle.

17. The warning system according to claim 16, wherein said housing has at least one transparent window to allow radiant energy to pass therethrough.

18. The warning system according to claim 2, wherein said energy source emits infrared light.

19. The warning system according to claim 1, wherein said ophthalmic contact device is a contact lens having a perimeter, and wherein said detectable feature is a microcircuit located near said perimeter of said contact lens.

20. The warning system according to claim 1, wherein said ophthalmic contact device is a contact lens having a plurality of barcodes which form said detectable feature.

* * * * *